United States Patent [19]

Hirmann

[11] 3,975,989

[45] Aug. 24, 1976

[54] PRESSURE RESPONSIVE FORCE TRANSMISSION APPARATUS

[75] Inventor: Georg Hirmann, Zurich, Switzerland

[73] Assignee: Rudolf Felix Homberger, Schaffhausen, Switzerland

[22] Filed: Apr. 4, 1974

[21] Appl. No.: 458,008

[30] Foreign Application Priority Data

| | | |
|---|---|---|
| Apr. 19, 1973 | Switzerland | 5731/73 |
| Feb. 28, 1974 | Switzerland | 2821/74 |

[52] U.S. Cl. ..... 92/48; 92/64; 92/91; 92/99

[51] Int. Cl.[2] ..... F01B 19/02

[58] Field of Search ..... 92/34, 37, 39, 42, 44, 92/45, 46, 48, 89, 90, 91, 92, 97, 128, 129, 255, 101, 64, 99

[56] References Cited

UNITED STATES PATENTS

| | | | |
|---|---|---|---|
| 1,054,197 | 2/1913 | Goyder | 92/44 X |
| 2,226,201 | 12/1940 | Freyssinet | 92/92 X |
| 2,467,883 | 4/1949 | Edwards, Jr. | 92/48 X |
| 2,621,769 | 12/1952 | Cardwell | 92/90 X |
| 2,758,466 | 8/1956 | Belcher | 92/101 X |
| 2,893,431 | 7/1959 | Bowditch | 92/42 X |
| 2,969,046 | 1/1961 | Kellogg | 92/99 X |
| 2,981,234 | 4/1961 | Appleton | 92/48 X |
| 3,016,884 | 1/1962 | Merriman | 92/90 X |
| 3,044,596 | 7/1962 | Bowerman | 92/92 X |
| 3,556,465 | 1/1971 | Little | 92/91 X |
| 3,643,496 | 2/1972 | Zajic | 92/37 X |
| 3,735,671 | 5/1973 | Pennucci | 92/90 |
| 3,807,285 | 4/1974 | Phillips | 92/255 |

FOREIGN PATENTS OR APPLICATIONS

| | | | |
|---|---|---|---|
| 1,112,743 | 3/1956 | France | 92/34 |
| 1,206,414 | 9/1970 | United Kingdom | 92/48 |

*Primary Examiner*—Martin P. Schwadron
*Assistant Examiner*—Abraham Hershkovitz
*Attorney, Agent, or Firm*—Pennie & Edmonds

[57] ABSTRACT

Pressure responsive force transmission apparatus such as may be used in automatic controls and for hydraulic and pneumatic lift or force mechanisms comprises a pair of substantially rigid lift elements each having a base plate, at least two guide arms projecting from the base plate, and at least two guide surfaces at the sides of the base plate. The pair of lift elements is mated together each with its guide arms engaging the guide surfaces of the other. A flexible inflatable bladder is disposed between the base plates of the mated lift elements. One of the lift elements is formed with a fluid transmission passage communicating with the interior of the bladder. By delivering fluid under pressure through said passage, the bladder is inflated and causes the lift elements to move apart.

15 Claims, 10 Drawing Figures

PRESSURE RESPONSIVE FORCE TRANSMISSION APPARATUS

SUBJECT OF THE INVENTION

The present invention relates to pneumatic or hydraulic lift-or force-applying apparatus. The new apparatus comprises rigid lift elements between which an inflatable bladder is disposed to move the lift elements relative to one another. The apparatus is designed to permit two or more substantially identical units to be assembled together to increase the force, or to increase the relative displacement, of the lift elements to meet a variety of different operating conditions.

BACKGROUND OF THE INVENTION

Hydraulic or pneumatic piston-cylinder devices are commonly used in force or lift apparatus. Depending on the application involved, different sizes or working cylinders must be available for different lifts (strokes) as well as for different force (power) effects. To cover all requirements, therefore a wide range of different piston diameters and piston strokes are necessary. The stocking of such components for a diversity of requirements necessitates a large amount of capital. Another disadvantage of pneumatic or hydraulic piston and cylinder devices is that the size of the end face of the piston is determined by the desired force, or by the pressure of the medium. Reduction of the piston area requires increased pressure of the medium to deliver a given force. For high forces, therefore, undesirably large piston areas may be required.

Pressurized devices for force or lift apparatus utilizing inflatable bellows, which may be connected either in parallel (force addition) or in series (lift addition) are known. Such devices are complicated in construction, are expensive, and are liable to damage. They are generally rigid in construction, and single elements cannot be combined at will to form units which take account of the desired conditions in optimal manner.

STATEMENT OF THE INVENTION

It is the purpose of the present invention to overcome the foregoing disadvantages, by the provision of a unit comprising at least two lift elements to be mated together, guiding each other, and having a bladder or distendable diaphragm arranged between them.

The apparatus of the invention thus comprises a pair of substantially rigid lift elements each having a base plate, at least two guide arms projecting from the base plate, and at least two guide surfaces at the sides of the base plate, said pair of lift elements being mated together each with its guide arms engaging the guide surfaces of the other. A flexible bladder is disposed between the mated lift elements, and at least one of the lift elements is formed with a fluid transmission passage communicating with the interior of the bladder, whereby fluid under pressure delivered through said passage inflates the bladder and causes the lift elements to move apart.

Preferably each lift element has two guide arms disposed at opposite sides of a symmetrical base plate, and the guide surfaces are disposed on the sides of the base plate midway between the guide arms.

The fluid transmission passage is formed preferably by intersecting bores in the base plate and guide arms. The ends of such bores are closed by plugs or otherwise except where fluid is to be delivered into or is intended to flow out of the passage. Such plugs or other bore closures preferably are designed to be readily punched out or otherwise removed whenever it is desired to make a connection to the passage. An advantageous arrangement is to provide a centrally located bore extending through the base plate, a second bore extending from an edge of the base plate to intersect said centrally located bore, and a third bore intersecting the second bore and extending axially through one of the guide arms.

The bladder advantageously comprises a pair of flexible sheets peripherally sealed together, one (or in some cases both) of said sheets having therein an opening which is disposed in alignment with the fluid transmission passage in the lift element. The bladder and lift element are sealed together about such aligned opening and passage, so that fluid under pressure may flow readily, without leakage, from the passage into the interior of the bladder. Alternatively, the bladder may comprise a single flexible membrane peripherally sealed to the base plate of one of the pair of lift elements, to form therewith a closed chamber having a rigid wall and a flexible wall, the fluid transmission passage in such case preferably opening nto said chamber through the rigid wall.

It is a particular feature of the invention that two or more pairs of lift elements may be superimposed to provide for force or lift amplification. To this end all the lift elements are preferably of the same size and shape. Then, to superimpose pairs of mated lift elements, the second pair is mounted as on the first pair, usually with the guide arms of the second pair abutting against surfaces of the first pair in alignment with the guide arm of the first pair. With the fluid passages extending axially through the guide arms, transmission of fluid from one to the other end of the superimposed pairs is thus readily provided through the aligned guide arms and passages. In this manner any desired number of units may be assembled together, in modular fashion, in order to adapt the forces to be exerted and/or the required lifts to the circumstances. With all the lift elements of the same design, they can be assembled together either co-directionally or counter-directionally.

BRIEF DESCRIPTION OF THE DRAWINGS

The invention will be explained below by way of example with reference to the accompanying drawings, in which.

DETAILED DESCRIPTION OF THE INVENTION

Figure 1:
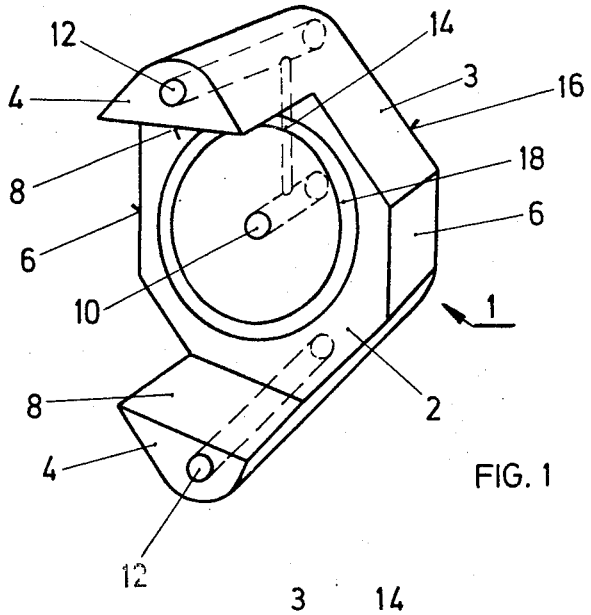
FIG. 1 is a perspective view of a preferred form of lift element.
Figure 2:
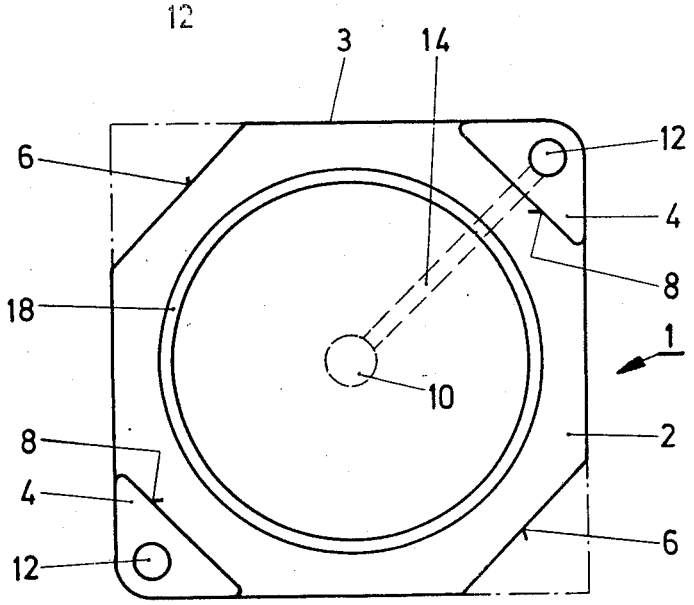
FIG. 2 is a plan of the lift element of FIG. 1.
Figure 3:
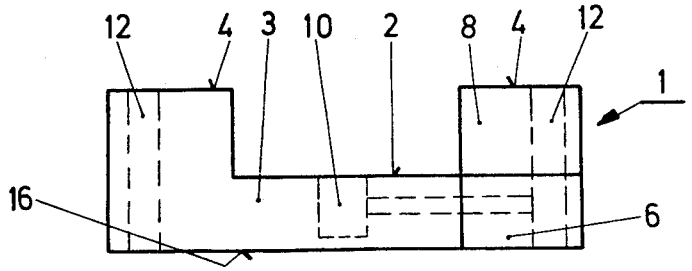
FIG. 3 is a side view of the lift element of FIG. 1.

As shown in FIGS. 1–3, each lift element 1 comprises a base plate 3 of originally square cross-section. At two opposite corners, perpendicular to a base plate surface 2, two guide arms 4 protrude therefrom. The guide arms 4, as shown, are substantially prismatic. They are preferably integral with the base plate 3 so that their outer edges are defined by an extension of diagonally opposite corner portions of the base plate 3. Each of the two guide arms 4 has a guide surface 8 extending normal to the base plate surface 2 and parallel to the diagonal of the base plate connecting the corners thereof not extended to form the guide arms 4. At these corners the edges of the base plate 3 are cut parallel to the diagonal which connects the two guide arm corners to form guide surfaces 6. The length and spacing apart of the guide surfaces 6 correspond to the width and distance apart of the guide arm surfaces 8.

The base plate 3 has a base plate bore 10, preferably centrally located, which may be plugged at one or both base plate surfaces 2 and 16 by an easily displaced plug (not shown). In each of the guide arms 4 a continuous bore 12 extends normal to planes 2 and 16. A bore 14 in the base plate 3 intersects both the base plate bore 10 and the bore 12 in one of the guide arms. This bore 14 may be drilled or otherwise formed inwardly from the corner edge of the base plate, and may then be plugged at its outer end.

The base plate surface 2 preferably is formed with a concentric circular groove 18, whose inner edge is rounded.

The lift elements 1 are advantageously made of plastic; and the plugs which close the ends of the bore 10 can be removed or displaced when necessary.

Figure 4:
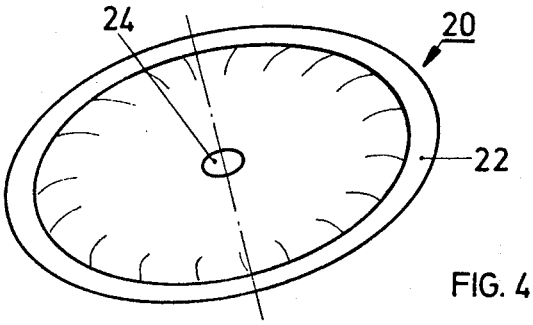
FIG. 4 is a perspective view of a preferred form of bladder.

FIG. 4 shows convenient form of bladder 20. It consists of two superimposed circular sheets or films, preferably of plastic, which are sealed together at their edges, for example by heat sealing. Thus an edge zone 22 is formed. The inside diameter of the edge zone 22 is somewhat larger than the inside diameter of the circular groove 18 in the base plate 3. Thereby the bladder 20 is protected from fold damages at its marginal areas, as these marginal areas, as shown for example in FIG. 7, can be received in the open circular grooves 18 of the base plate 3. One of the circular films forming the bladder has an opening 24 which is preferably centrally located.

Figure 5:
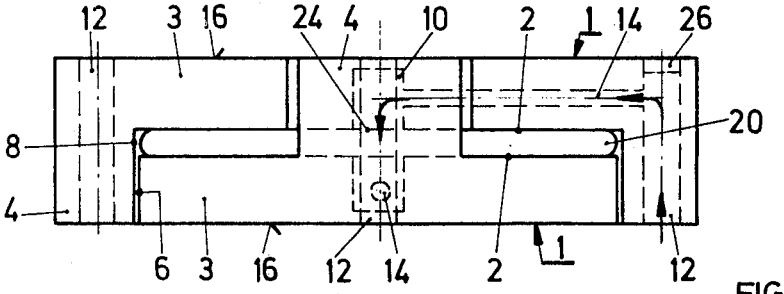
FIG. 5 is a side view of mated lift elements and bladder.
Figure 6:
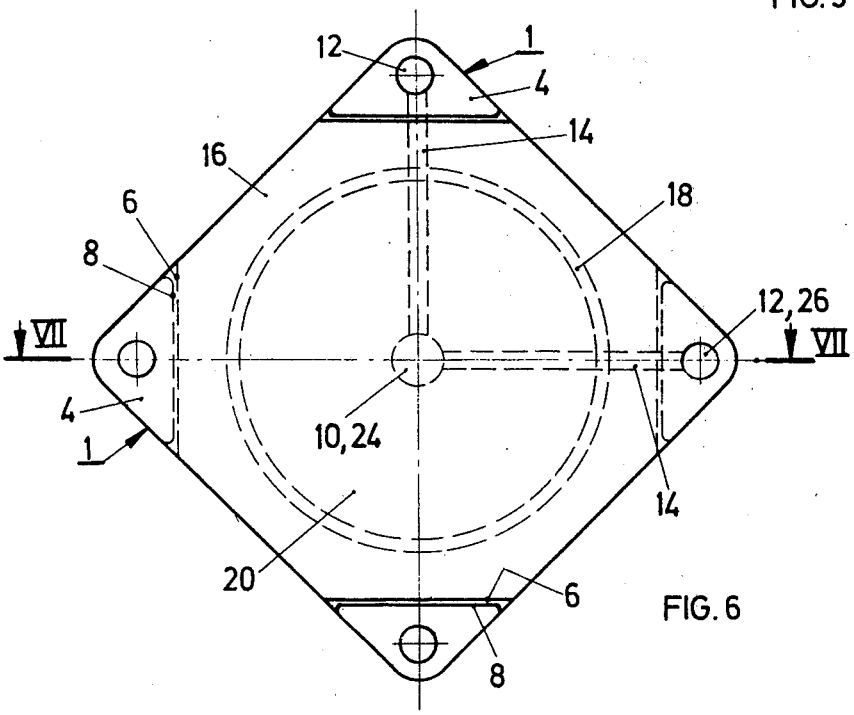
FIG. 6 is a plan of the assembly of FIG. 5.

FIGS. 5 and 6 show how in principle a pair of lift elements 1 are mated together as a force-lift unit with a bladder 20. The two lift elements 1 are interengaged with their respective surfaces 2 toward each other, and they are rotated by 90° relative to each other so that the guide surfaces 8 of the guide arms 4 of one lift element 1 engage with the guide surfaces 6 at the edges of the base plate 3 of the other element 1. Thereby the two elements 1 are movable toward and away from each other but are guided in such motion ay the guide arms 4 and guide surfaces 6.

Between the two base plate surfaces 2 a bladder 20 is inserted. The area around the central bladder opening 24 is sealed, for example by a bilaterally adhesive washer or by an adhesive applied directly, to the base plate surface 2 of the adjacent lift element 1 in such a way that the central opening 24 communicates with the bore 10 of the lift element. Alternatively the bladder may be formed with a nipple which sealingly engages in the bore 10. However the connection is made, a fluid under pressure, such as compressed air, may flow into the bladder 24 through the bores 12 and 14 and the bore 10, as indicated by the arrows in FIG. 5. The opening of the bore 12 not needed for introducing compressed air is closed with a plug 26. Similar plugs may close the ends of the other bores, and such plugs may be punched out whenever and wherever it is necessary to open the bores to the exterior. As the bladder 12 is inflated, the upper lift element 1 rises from the lower. The force exerted depends on the pressure of the medium and on the pneumatically active surface area of the bladder 20. If the compressed air supply is released, the bladder 20 collapses and the lift elements may move back toward each other. Due to the dimensions of the bladder 20 and of the circular grooves 18, not all air necessarily escapes from the bladder 20 as it collapses. An annular portion of the bladder 20 may remain distended in the groove 18. Thus the inner edge of the bladder edge zone 22, which is usually subject to alternating stress, is protected from excessive loading.

Figure 7:
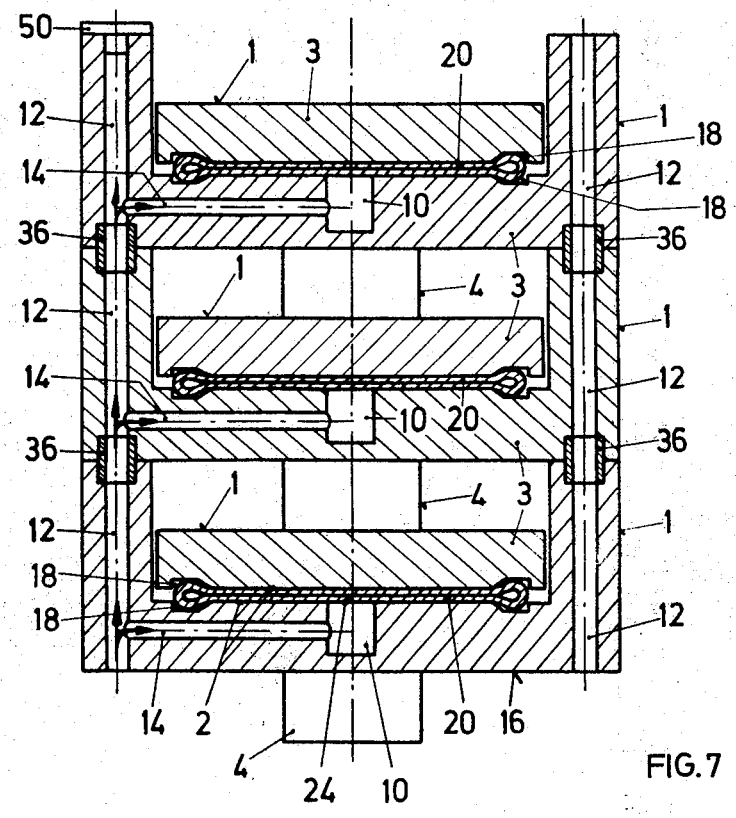
FIG. 7 is a section along a line such as VII—VII of FIG. 6 showing an assembly of several superimposed pairs of elements for force multiplication.

Some combinations of pairs of lift elements and their specific effects are described below. In FIG. 7, three groups each of two lift units, are arranged one above the other. The lowermost supports on its guide arms 4 the underside 16 of the base plate of the lower element of the unit next above; and this in turn supports on its guide arms 4 the underside 16 of the lower element uppermost of the three units. The mutually aligned bores 12 are connected fluid-tight by sealing sleeves 36 inserted in the bores 12 where the lift elements adjoin. Instead of being inserted into the bores 12, the connecting sleeves 36 may comprise collars or nipples arranged to connect the bores 12 of two abutted lift elements 1 tightly with one another.

The lowermost of the elements 1 supports on the upper side 2 of its base plate a bladder 20, which in turn supports the base plate 3 of a lift element which is rotated in relation to the lowermost by 90° and is mated therewith as shown in FIGS. 5 and 6. The same arrangement of a bladder 20 and of a lift element 1 rotated by 90° is repeated in each of the second and third of the superimposed free lift units, with the downwardly directed guide arms 4 of these elements bearing respectively on the upwardly facing surface 1 of the corresponding lift element next below.

The bores 10 of three elements 1 are open at the base plate top surface 2 and are adhesively sealed to the area around the central openings 24 of the bladders 20. The triad of lift elements 1 with their guide arms 4 directed upwardly is assembled so that one aligned set of bores 12 is connected by the channels 14 with the bores 10. The uppermost of such set of bores is closed by a seal plug 50. Through the lower opening of this aligned set of bores, a pressure medium such as compressed air is delivered through the channels 12 and 14 and through the base plate bores 10 into the bladders 20, as indicated by the arrows. A nipple (not shown) at the base plate surface 16 may provide for connecting the pressure source to the channel 12.

The three lift elements 1 overlying the bladders 20 form one movement group. By admitting the pressure medium, this movement group, (having downwardly pointing guide arms 4) is lifted with a force which is equivalent to three times the force which one bladder would effect at equal pressure of the medium. When external forces act on one of the movement groups, it is readily possible, when necessary, to connect such group together by bolts (not shown) which pass through the aligned bores 12. Such bolts fit loosely enough in the bores so that a free passage remains between the walls of the bores 12 and the bolts to allow the pressure medium to flow to the bladders.

By coupling a relatively large number of elements 1 and bladders 20 in this manner to form larger movement groups, it becomes possible to create very large resultant lift forces, without altering the size or active surface area of the lift elements or increasing the medium pressure. The total force is then essentially proportional to the product of the number of working bladders and the force of a single bladder.

Figure 8:
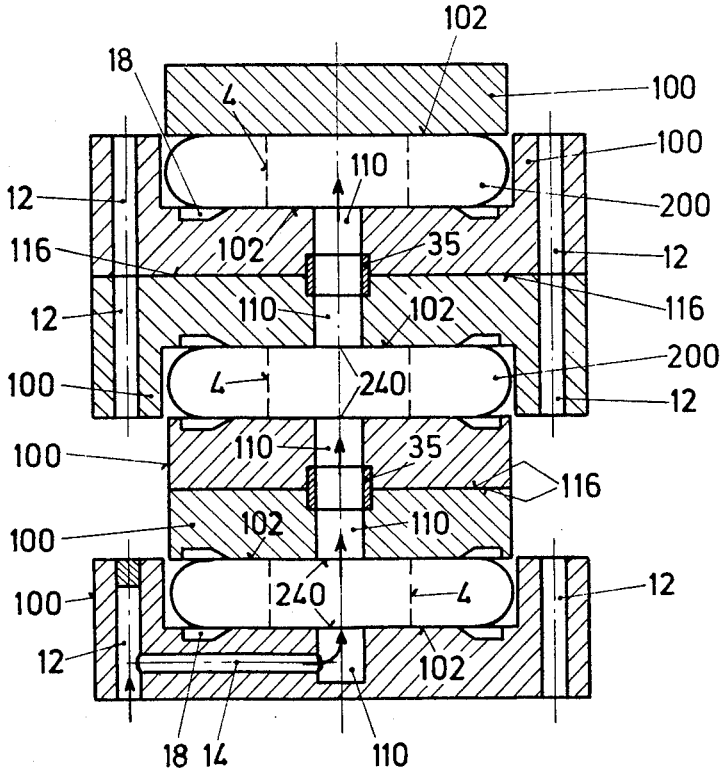
FIG. 8 is a section along a line such as VII—VII of FIG. 6 showing an assembly of several superimposed pairs of lift elements for lift multiplication.

In FIG. 8, a first bladder 200 is inserted between two lower lift elements 100 which are mated by being directed against each other and rotated by 90 degrees. The upper of this pair of lift elements 100 carries on its side 116 the corresponding side 116 of another element. Between the upper side 102 of the last named element 100 and the corresponding side 102 of another element 100 (again rotated by 90°), is a second bladder 200. This fourth lift element 100 carries in turn on its side 116 the underside 116 of a fifth element 100, between whose upper side 102 and the corresponding side 102 of a sixth element 100 a third bladder 200 is located. The first and second, the third and fourth, and the fifth and sixth lift elements, respectively in this assembly each form a lift group so that in the structures of FIG. 8 three lift groups exist. The base plate bore 110 of the lower most element 100 is open at the base plate surface 102 and, as has been described, is sealingly connected with the central aperture 240 of the lowermost bladder 200. The normally unperforated upper side of this bladder 200 is, in this combination, provided with a second central opening 240 which is sealingly connected with the bore 110 of the second lift element 100. The bores 110 of the second and third from the bottom of the elements 100 are tightly connected by a sealing sleeve 35. The bore 110 of the third element 100 opens through the corresponding central aperture 240 of the second bladder 200 into the latter. This second bladder 200, like the first, is perforated on both sides. Its second central aperture 240 is sealingly connected with the central bore 110 of the fourth lift element 100, which is connected by a sealing sleeve 35 with the central bore 110 of the fifth lift element 100. This bore 110 of the fifth lift element 100 opens by a central aperture 240 into an unilaterally perforated upper bladder 200. The entire arrangement is fed with a pressure medium, e.g compressed air, as indicated by the arrows in FIG. 8, through the bore 12 of the lowermost lift element 100, which is connected with bore 110 by a channel 14.

As the second, third, fourth and fifth lift elements 100 have no channels 14, the pressure medium flows into them through the bladders 200 connected in series. For this application it is advantageous to use lift elements which (except for the lowermost no channels 14, but if such channels 14 are present in all the lift elements, the intersecting bores 12 must be tightly closed to the outside with plugs.

As the three lift groups are axially displaceable relatively to each other, there acts on each the force which is caused by a single bladder 200. But the lift distance traversed by the uppermost element 1 is three times the lift distance which a single bladder 200 would cause at the same medium pressure.

Figure 9:
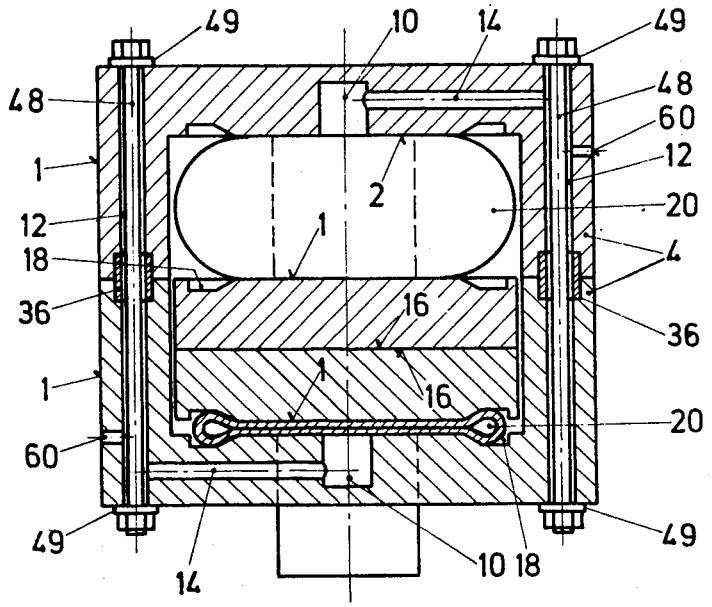
FIG. 9 is a section along a line such as VII—VII of FIG. 6 showing an assembly of two superimposed pairs of lift elements for an alternating operation.

In FIG. 9, the lowermost and uppermost lift elements 1 are set up with their guide arms 4 facing and abutting one another. In the space between them two additional lift elements 1 which are rotated 90 degrees into mated relation with the upper and lower elements, respectively, and are disposed with their sides 16 abutting one another. The two outer lift elements 1 are clamped together by bolts 48 which pass through the aligned bores 12 of the lift element guide arms 4. The bolt dimensions are such that a free passage remains between the walls of bores 12 and the bolts 48. The bores 12 are sealed at their ends by packing washers 49. Between the two inner lift elements 1 and the outer lift elements with which they are mated are two bladders 20. The upper bladder is fed through the bore 10, which opens into it through the upper lift element base plate surface 2. The lower bladder 20 is fed similarly by the base plate bore 10 of the lowermost lift element 1. The outer lift elements 1 are stacked so that the channel 14 of each opens into a different aligned pair of bores 12; for example the channel 14 of the lowermost element opens into the left bore 12, and that of the upper lift element 1 opens into the right bore 12.

In this arrangement the two inner lift elements must move together, either up or down depending on which of the two bladders 20 is being charged with a pressure medium. In other words, this is a positive acting controlled reset. The line bores 12 can be charged with pressure medium through feed apertures 60 in the guide arms 4.

Generally the distance through which the lifts may operate depends to a large extent on the dimensions of the guide arms 4 with respect to the thickness of the base plate 3; but it is readily possible to vary the lift ranges, and the space into which the lift elements may be fitted, by adding spacer pieces either to the guide arms or to the base plate top surface 2. Depending on their use, these spacer pieces (not shown) may be provided with bores to extend the length of the bores 12 or of the bores 10. In liftadding assemblies as described for example with reference to FIG. 8, additional lateral guiding means may be provided when a considerable number of lift element pairs are combined. The lift elements may alternatively have other cross-section forms than shown (for example, they may be of circular form), and they may be provided with more than two (e.g. three) guide arms each. The square cross-section form of the base plate, however, is advantageous.

Figure 10:
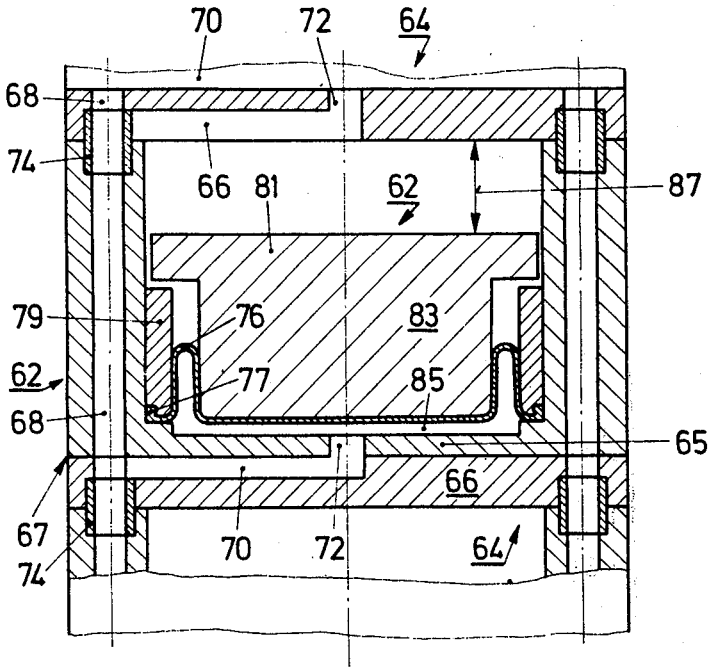
FIG. 10 is a sectional view through an assembly of lift elements incorporating a roll membrane as the flexible component of the bladder.

FIG. 10 shows in axial section a modified form of lift unit, with fractions of the adjacent lift units assembled with it being also shown. In this modification one lift element 62 comprises a divided base plate 64 having an inner part 65 and an outer part 66. The interface between the two parts 65 and 66 is indicated at 67. Axial bores 68 are provided in the guide arms, as well as channels 70 of rectangular cross-section which are connected at tone end with the bore or bores 68 and at the other end with a base plate bore 72. The successive lift elements of like function are interconnected rigidly by sleeves 74 sealingly connecting the respective bores 68 of the elements 62.

Secured to one of the lift elements 62 is a roll membrane 76 which is fixed in place by means of a bead 77 and a holding sleeve 79. The cooperating lift element 62 comprises a base plate 81 which carries a piston 83 resting on the membrane 76 in the manner shown in FIG. 10. Between the membrane 76 and the rigid inner part 65 is a bladder space 85 which is connected with a pressure medium source through the base plate bore 72, the rectangular channel 70 and the bores 68.

When a pressure medium is delivered into the bladder space 85 the piston 83 with the base plate 81 and the remainder (not shown) of the lift element associated with it is raised. The maximum lift of this element in the assembly shown, is indicated at 87. This design offers the advantage that it can be used for relatively large, single stage lifts. The formation of the channels 70, when the parts are made by plastic injection molding, is extremely simple. The inner part 65 may in such case be joined to the outer part 66 at the interface 67 by gluing.

The herein described force-lift unit has the advantage that various combinations of possibilities can be assembled readily, e.g. combinations of force and lift multipliers. Reset of the assembly can be effected by springs or by hydraulic or pneumatic bellows or bladders. The same units can be easily assembled for force and/or lift addition. In consequence of the provision of internal connecting lines such as the axial bores 12 and the base plate bores 10, it is possible to make assemblies with a minimum of external connecting means such as rubber tubes. The pressure forces of the bladder 20, which act on the corresponding lift elements, ensures that the seal connection of the bladder to the base plate by a bilaterally adhesive ring actually is improved with increasing pressure. As the lift elements can be made of plastic, the cost of manufacture and of stockkeeping is minimal, compared with conventional constructions designed for similar purposes.

I claim:

1. Pressure responsive force transmission apparatus comprising a pair of substantially rigid lift elements each having a base plate, at least two guide arms projecting from the base plate, and at least two guide surfaces at the sides of the base plate, said pair of lift elements being mated together each with its guide arms engaging the guide surfaces of the other, and a flexible collapsible chamber wall portion disposed between the mated lift elements, at least one of said lift elements being formed with a fluid transmission passage communicating with the collapsible chamber wall portion; the fluid under pressure being delivered through said passage to displace said wall portion and causing the lift elements to move apart.

2. Apparatus according to claim 1, wherein each lift element has two guide arms disposed at opposite sides of a symmetrical base plate, and the guide surfaces are disposed on the sides of the base plate at positions midway between the guide arms.

3. Apparatus according to claim 1, wherein the fluid transmission passage is formed by intersecting bores in the base plate and guide arms, the ends of said bores being closed by plugs except where fluid is delivered into or intended to flow out of the passage.

4. Apparatus according to claim 3, wherein a centrally located bore extends through the base plate, a second bore extends from one edge of the base plate adjacent a guide arm to intersect said centrally located bore, and a third bore intersecting said second bore extends axially through said guide arm.

5. Apparatus according to claim 3, wherein at least one of the plugs closing the end of the bore is readily displaced therefrom to open the bore for the purpose of making a connection thereto.

6. Apparatus according to claim 1, wherein said flexible collapsible chamber wall portion includes an inflatable bladder which comprises a pair of flexible sheets peripherally sealed together, one of said sheets having therein an opening which is disposed in alignment with the fluid transmission passage in the lift element, said bladder sheet and lift element being sealed together about the aligned opening and passage.

7. Apparatus according to claim 6, wherein the bladder and lift element are sealably connected together by a perforated disc, said disc having opposed sides coated with adhesive.

8. Apparatus according to claim 6, wherein the base plate of at least one of the lift elements is grooved in the region overlain by the peripherally sealed edges of the bladder to avoid pinching of the bladder periphery when the lift elements flatten the bladder between them.

9. Apparatus according to claim 1, wherein a second pair of lift elements is superimposed on the first pair with the guide arms of said second pair abutting against surfaces of the first pair in alignment with the guide arms of said first pair.

10. Apparatus according to claim 9, wherein the fluid transmission passages extend axially through at least one of the guide arms of each pair, and the superimposed pairs of lift elements are arranged with the fluid passages through their respective guide arms in alignment.

11. Apparatus according to claim 10, wherein connecting sleeves in the fluid transmission passages interengage with the superimposed pairs of lift elements and seal the aligned passages together in fluid tight relation.

12. Apparatus according to claim 1, wherein the collapsible wall portion includes a bladder which comprises a flexible membrane peripherally sealed to the base plate of one of the pair of lift elements to form therewith a closed chamber having a rigid wall and a flexible wall, the fluid transmission passage opening into said chamber through the rigid wall.

13. Apparatus according to claim 12, wherein the periphery of the membrane is surrounded by a rigid cylinder, and the base plate of the other of the pair of lift elements includes a rigid piston fitting with said cylinder.

14. Apparatus according to claim 13, wherein an annular space is provided between the cylinder and piston, and an annular portion of the membrane penetrates into said annular space, whereby the membrane expands and contracts as a role membrane.

15. Pressure responsive force transmission apparatus comprising a pair of substantially rigid lift elements each having a base plate, at least two guide arms projecting from the base plate, and at least two guide surfaces at the sides of the base plate, said pair of lift elements being mated together each with its guide arms engaging the guide surfaces of the other, and a flexible inflatable bladder disposed between the mated lift elements and having a freely movable peripheral end, at least one of said lift elements being formed with a fluid transmission passage communicating with the interior of said bladder, the fluid under pressure being delivered through said passage inflates the bladder and causes the lift elements to move apart.

* * * * *